United States Patent [19]

Helterbrand et al.

[11] 3,942,763

[45] Mar. 9, 1976

[54] ADJUSTABLE WROUGHT IRON RAILING ASSEMBLY

[75] Inventors: Arlen Helterbrand; Zack H. Logan, both of Louisville, Ky.

[73] Assignee: A-T-O Inc., Willoughby, Ohio

[22] Filed: Feb. 4, 1974

[21] Appl. No.: 439,333

[52] U.S. Cl. ..... 256/22; 256/65

[51] Int. Cl.[2] ..... E04H 17/14

[58] Field of Search ..... 256/21, 65, 19, 1, 59, 256/22; 403/187, 231, 245, 262

[56] References Cited

UNITED STATES PATENTS

| | | | |
|---|---|---|---|
| 2,590,929 | 4/1952 | Bush | 256/21 UX |
| 2,771,276 | 11/1956 | Constance et al. | 256/22 |
| 2,820,613 | 1/1958 | Schilling | 256/21 |
| 3,031,217 | 4/1962 | Tinnerman | 403/262 X |
| 3,136,530 | 6/1964 | Case | 256/65 X |
| 3,195,937 | 7/1965 | Case | 256/65 X |
| 3,258,250 | 6/1966 | McMullin | 256/13.1 |
| 3,304,683 | 2/1967 | Ferreira | 256/65 X |

FOREIGN PATENTS OR APPLICATIONS

| | | | |
|---|---|---|---|
| 602,540 | 5/1948 | United Kingdom | 403/262 |
| 782,428 | 9/1957 | United Kingdom | 403/187 |

*Primary Examiner*—Dennis L. Taylor
*Attorney, Agent, or Firm*—John K. Crump

[57] ABSTRACT

An adjustable type connector means for a wrought iron railing section having top and bottom rail elements of inverted, generally U-shaped cross-sectional construction includes a pair of plate-like members adapted to be assembled to an end of one of the rail elements in opposed, paralleling relation with one another, with a first of the members disposed within the rail element above and in seated relation with a pair of opposed, inwardly extending right-angle abutment means formed integrally in the sides of the rail element and with the second of the members disposed along the underside of the rail element in engaged, bridging relation with the extremities of the sides of said rail element. The plate members are adapted to be operatively coupled with one another to retain the rail element in compression therebetween through means of a mounting bolt fitting through an aperture in the second of the members to within a suitably tapped aperture in the first of the members.

The first of the members has an apertured extension projecting angularly from the end of the rail element to present a separate attachment or mounting surface for a fixed support for the railing section.

1 Claim, 3 Drawing Figures

Fig. 1
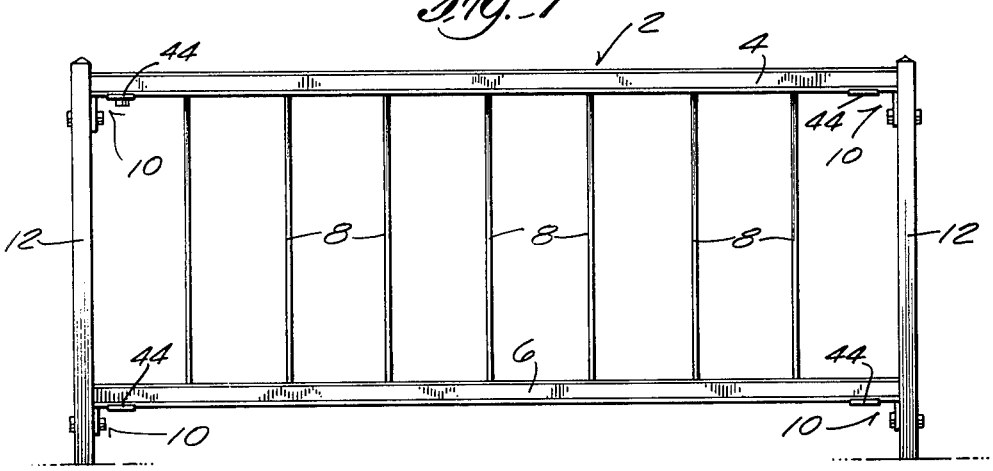
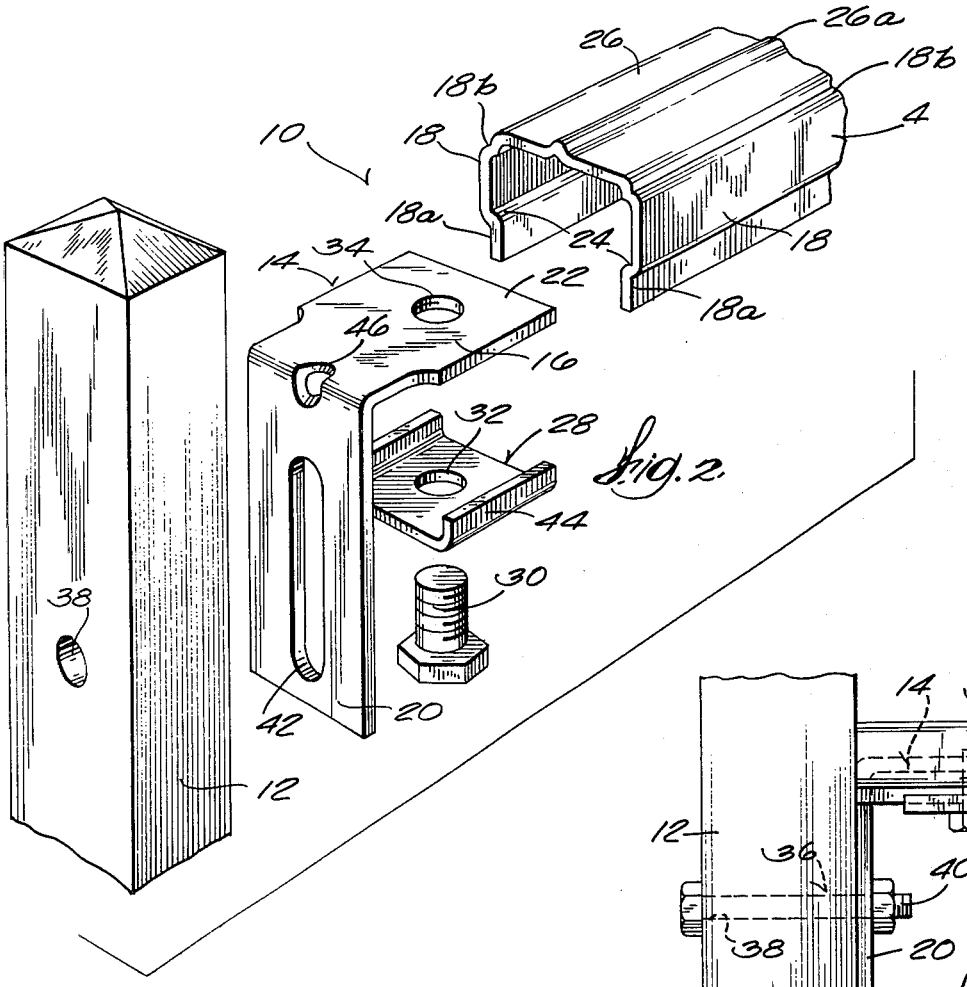
Fig. 2
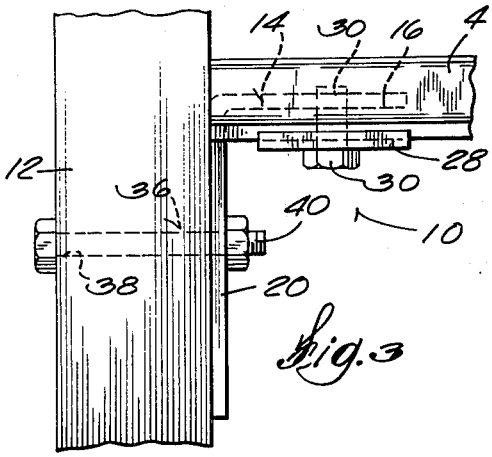
Fig. 3

ADJUSTABLE WROUGHT IRON RAILING ASSEMBLY

This invention relates to wrought iron railings and in particular relates to ornamental railing sections of the type designed for residential installation by relatively unskilled personnel, using only commonly available hand tools.

Wrought iron railing sections of the present type generally include elongated top and bottom rail elements connected to one another in spaced apart, paralleling relation by a series of pickets or spindles which are characterized by end portions of reduced sectional thickness to permit the section as a whole to be readily pitched or raked where installation is to be effected along steps or a ramp, for example. The individual railing sections are designed to be attached to fixed supports such as newel posts whereby to form an installed railing unit or assembly of desired form or configuration through means of individual connector means fitting between the ends of the top and bottom rail elements of the section and the newel posts or other fixed supports.

While the connector means may take the form of conventional nut and bolt type fasteners, it generally is necessary in the installation of these railing sections to effect an on-site cutting of the rail elements of the section in order to attain exact correspondence between the length of the section and the spacing of the supports and normally then with conventional type fasteners it becomes necessary to also subject the rail elements to an on-site drilling operation to provide the latter with necessary assembly holes or apertures for receipt of the fastener means. This necessity of drilling the rail elements not only adds a further step to the installation procedure but also renders the installation a matter which requires the availability of other than the hand tools normally possessed by the typical home owner or other do-it-yourselfer.

In order to enhance the appeal of wrought iron railing to the home owner or other do-it-yourselfer, it has been proposed to substitute for the conventional nut and bolt type fastener, an adjustable form of connector means which attaches to the rail elements of the railing section through a special clamp-on action such that its assembly to the rail element may be readily and conveniently effected without the need for assembly holes or apertures in the rail elements. This clamp-on or adjustable type connector means (also hereinafter referred to at times or a no-drill type connector means) is dependent for its effectiveness upon the presence in the rail elements of continuously extending, clamping or support surfaces and, to achieve this, it has been proposed to provide the rail elements of the section with an inverted, generally U-shaped cross-sectional configuration with the opposed legs or sides of the U being turned inwardly and back upon themselves to form a pair of longitudinally extending, opposed abutment surfaces in the rail interior.

The fastener means themselves, in accordance with this proposal, are essentially in the form of a right angle plate or bracket having opposed leg portions, with one of the leg portions being of arched cross-sectional construction and adapted to be adjustably or slidably received in the end of a rail element is suspended or bridging relation between the abutment surfaces formed in the opposed sides thereof. The arched leg of the plate or bracket is provided with a tapped opening for receiving a set screw which upon being drawn up into the opening acts against the inner surface of the center web or base portion of the rail element to place the arched leg portion of the plate in tension against the abutment surfaces in the rail element whereby to effectively connect the plate with the rail element. The opposed leg portion of the plate extends from the end of the rail element to present a second attachment or mounting surface suitable for connection with a fixed support such as a newel post by a conventional nut and bolt assembly, such leg portion typically being slotted for receiving the bolt portion of the assembly from the newel post.

While greatly simplifying and facilitating the installation of wrought iron railing sections by eliminating the need for any on-site drilling of holes in the rail sections, this general type of connector does, nonetheless, possess a number of drawbacks or limitations which detract from the overall effectiveness of the same as a fastener for wrought iron railing.

For one thing, in this type of connector, the side walls of the rail element are subjected to very appreciable tension forces by the outward flexing or expansion of the plate element or bracket and in order to prevent the walls from deforming or failing under load, it becomes necessary to form the rail elements of fairly heavy gauge material. This not only increases the cost of the railing with commensurate increase in shipping or freight charges, but also adds to the weight thereof, thereby making it more difficult to handle the section during installation. The cutting of the rail elements also becomes more difficult as the gauge of the elements increases.

Then too, this type of connector results in the presence in the rail element of a joint or attachment of limited stability and strength insofar as bending and torsional loads are concerned and particularly severe cases of such loading may result in a deformation of the connector and/or the rail elements proper with a consequential loss of tightness between the connector and rail element.

A further drawback of this type of connector means is brought about by the need for maintaining a relatively close fit between the arched leg portion of the plate and the sides of the rail element to insure a proper suspension of the plate between the rail element side support surfaces. This, coupled with the requirement of holding the gap between the leg and the center web portion of the rail element to a level which can be spanned by a relatively short length set screw, leads to problems in installing the plate within the rail element as, in cutting the latter to the length required for installation, burrs invariably form in the rail elements along the cutting edges thereof, making it impossible or difficult at best to insert the plate in position without first removing the burrs, as by filing. An extra or additional operation is then usually necessary in the installation of the railing sections due to this particular characteristic of the existing types of adjustable connector means.

With the aforegoing in mind, it may be stated that the present invention is directed to an improved form of no-drill or adjustable type connector for wrought iron railing sections and which in addition to being mountable to the individual rail elements of the section is an extremely accurate and facile manner is capable of interacting with the rail elements to produce an inherently more stable, higher strength connection thereto than heretofore possible with existent forms of nodrill type connectors.

The present connector means are designed to be particularly employed with railing sections incorporating rail elements which are contoured in cross-section to include a pair of opposed wall segments depending from a center web or base portion and formed at corresponding positions along their length with special right-angle abutment surfaces or shoulders projecting inwardly of the rail element.

The connector means, in accordance with a preferred embodiment of the invention, includes an L-shaped connector clip adapted to be assembled for coupling action between a rail element and a fixed support such as a newel post, with a first of its leg portions extending within the end of the rail element above and in spanning or bridging relationship with the abutment surfaces and with the opposed or second leg portion of the clip projecting perpendicularly downwardly from the end of the rail element. A U-section bearing plate is adapted to bridge between the lower ends of the rail element side walls directly opposite to the first leg portion of the clip and is provided with a central aperture adapted to be aligned with a threaded hole in the first leg portion of the clip to provide for the assembly therebetween of a machine bolt which is adapted to act through the leg portion and plate to retain the rail in firmly clamped position therebetween.

The second leg portion of the clip is slotted to provide for the connection of the clip to the newel post or other support by a conventional type fastener means such as a nut and bolt assembly, for example, the leg portion being bendable relatively of the other or first leg portion of the clip to adapt the same to a railing section which is to be pitched or raked relatively of its supportive structure.

There thus is provided a connector means which may be employed to connect a railing section to a fixed support and which is adjustably connectible with the rail elements of such section through a clamping action, whereby to eliminate the necessity of holes or apertures being present in the rail element for permitting the assembly thereto of fastener means. The described connector means achieves this no-drill type assembly feature by an arrangement which results in the rail elements being held in compression rather than in tension and because of this there is a reduced tendency of the rail element to sustain sectional distortion or deflection during the fastening thereto of the connector means.

Also, with the novel construction of the invention, the connector means is in surface-to-surface contact with the rail element at two separate positions along both sides of the element, thereby affording a high degree of stability to the rail elements as well as to the railing sections themselves in the final, installed railing unit.

The connector means of the invention is of further advantage in that its efficacy is not dependent upon the maintenance of a close tolerance between the inner surfaces of the rail elements and the interfitting leg portion of the connector clip. Accordingly, with the present fastener means a rather generous all-around clearance may be maintained between the clip and the internal surfaces of the rail element so that despite the forming of burrs in the end of the rail element during the preliminary cutting of the rail section to the length required for installation the clip may, nonetheless, be assembled readily to the rail element.

Other objects and advantages of the present invention will appear in the course of the detailed description of the invention appearing hereinafter.

The accompanying drawings illustrate the best mode presently contemplated or carrying out the invention;

In the drawings:

FIG. 1 is a side elevation of a railing section illustrating the general manner in which the section is mounted between a pair of fixed supports by the improved connector means of the invention;

FIG. 2 is an enlarged view of a fragmentary portion of the railing section of FIG. 1 showing the construction and general arrangement in the railing section of one of the connector means of the invention, with parts broken away and shown in section for purposes of clarity; and FIG. 3 is a vertical section taken on the lines 3—3 of FIG. 2, showing further details of the connector means and the manner in which it is assembled within the railing section.

Referring now to the drawings, a wrought iron railing section 2 embodying the improvements of the invention includes identically formed top and bottom rail elements 4 and 6 of inverted, generally U-shaped cross-sectional construction, in combination with a series of spindles or pickets 8 arranged at uniformly spaced intervals to one another between the rail elements and connected thereto as by welding to form a rigid, generally rectangular rail structure having well known ornamentative or decorative qualities. The rail elements have connector means 10 assembled to their opposed ends for supporting the section as a whole between a pair of suitable fixed supports 12 such as newel posts, whereby to provide an installed railing unit capable of being combined with additional such sections and supports to form a complete railing assembly of desired shape or configuration.

While in the particular construction shown the railing section is mounted perpendicularly of the posts, it is to be noted that in certain installations, such as those involving steps or ramps, for example, it is necessary to "pitch" or "rake" the section to a particular slope or angle prior to its assembly to the posts. In order to facilitate this "pitching" or "raking" it is common to provide the spindles with "weakened" end portions and/or to join the spindles to the rail elements through yieldable type welds so as to permit the rail elements to be shifted relatively of one another in the direction of their lengths into the general form of a parallelogram by application of a relatively light force to the ends of one or both rail elements at the site of installation. A typical such spindle construction and mounting is set forth in U.S. Pat. No. 3,343,811, dated Sept. 26, 1967, and reference may be made thereto for a more complete understanding as to the techniques involved in installing "pitched" or 37 raked" type railing sections.

A detailed showing of one of the connector means 10 in operatively assembled position between a rail element and newel post is contained in FIGS. 2 and 3 of the drawings and particulate reference is made thereto in connection with the ensuing description of a presently preferred form of the invention. As shown therein, the connector means includes an L-shaped clip or bracket 14 disposed with a first, shorter of its leg portions 16 extending horizontally within the end of rail element 4 or 6 between the opposed walls 18 thereof and with its opposed, longer leg portion 20 depending from the end of the rail element in substantially 90° relation with the leg portion 16. The leg portion 16 is enlarged transversely as indicated at 22 and, in accordance with the invention, is adjustably or slidably seated in the rail element 4 or 6 so as to support the clip generally therein through means of a pair of opposed right-angle abutment means or shoulders 24 which are formed integrally in the opposed sides of the rail element generally medially of the vertical projection of the walls from the upper base or web portion 26 of the rail element. The leg portion 14 as thus positioned in the rail element 4 or 6 is adapted to be connected with a separate bearing plate 28 which is designed to be located in bridging relation between the lower ends of the rail element side walls 18 by a threaded fastener means in the form of a machine bolt 30 extending upwardly through an aperture 32 in the center of plate 28 to within a suitable tapped hole 34 in leg portion 16, the bolt being operative as it is tightened in place to draw the leg portion 16 and the plate 28 into firm clamping relation with the rail element 4 or 6. The clip and plate thus in effect form a clamp assembly which is capable of being attached to the end of a rail element 4 or 6 in a manner which completely obviates the need for the rail element to be provided with assembly holes or apertures or some type of prefixed securement means for enabling the attachment thereto of a connector or fastener means. The longer leg portion 20 of clip 14 is attached directly to the newel post to thereby connect the rail element 4 or 6 and the railing section 2 as a whole to the post as by a conventional nut and bolt assembly 36, there being one or more suitably predrilled, transversed holes 38 in the ends of the newel post for accommodating the bolt portion 40 of such assembly and an elongated slot 42 being provided in the leg portion to receive the bolt from the newel post. The provision of the slot 42 in leg portion 20 is of advantage in allowing the railing sections to be adjusted vertically of the newel posts for purposes of aligning intersecting sections with one another and/or for attaining alignment of a horizontal section with a section of raked rail at this point of intersection.

In a preferred construction of the invention, the abutments 24 contained in the rail elements 4, 6 are accorded a relatively wide transverse dimension so that the clip may properly engage therewith upon the assembly of the clip to the rail element without the necessity of a close correspondence between the lateral dimension of the leg portion and the inside lateral dimension of the rail element in the portion thereof above the abutments. Also, with the present construction, the development by the connector means of a clamping force against the rail element is not dependent upon the leg portion 16 of the clip lying in close proximity with the web portion 26 of the rail element in the assembled position of the connector means as it is, for example, in connector means of the type which include a clip in threaded support of a machine screw adapted to act between the clip and the web portion of the rail element to connect the clip with the rail element. Accordingly, it is possible with the instant connector means to maintain a rather generous clearance between leg portion 16 and rail element 4 or 6 both as regards the side walls 18 and the base or web portion 26 of the same and as a result of this the assembly of the clip to the rail element normally will not be hindered or prevented by reason of the presence in the end of the rail element of burrs or other irregularities arising out of the cutting of the rail elements in the preliminary stages of the installation procedure.

According to a further novel aspect of the invention, the bearing plate 28 is formed along its opposed edges with flanges 44 designed to seat immediately along the outboard edges 18*a* of the walls 18 in the assembled position of the plate to the rail element. These flanges act to positively center plate 28 relatively in the longitudinal axis of the rail element, thereby facilitating the assembly of the connector means to the rail element. The flanges further serve to co-act with the edges 18*a* of the railing element to prevent bearing plate 28 from turning relatively of the rail element during the tightening of the machine bolt 30, thereby further simplifying assembly procedures.

Generally, in the installation of a railing section 2 incorporating the improvements of the invention, a pair of vertical supports such as newel posts 12 are initially anchored in place in predetermined, spaced relationship with one another as by lag screws or other conventional type fasteners (not shown), which normally are extended through a suitable plate on the base of the posts from a fixed position in a sidewalk, porch, ramp or the like. A length of railing section is then prepared for installation between such posts or other support structure by effecting a preliminary on-site cutting of the ends of the longitudinal rail elements 4, 6 of the section to the dimension required to span the distance between the posts. Individual of the connector means 10 are then mounted to the opposed ends of each of the rails 4, 6 by a procedure which for any one of the rails entails an initial insertion of the leg portion 16 on the clip 14 within the end of the rail between the web portion 26 thereof and the shoulder-like abutments 24 which are integral with the side walls 18 of the rail. A bearing plate 28 is then fitted along the underside of the rail element opposite to leg portion 16 of the clip, with the flanged edges 44 of the plate located over the edges 18*a* of the rail element side walls 18 and with the plate and clip positioned relatively of one another in a manner so as to align the aperture 32 in the plate with the tapped opening 34 in leg portion 16. With the parts thus positioned, a machine bolt 30 is then inserted through plate 28 and to a position of threaded engagement with the tapped opening 34 in leg portion 16. The bolt can at this time be drawn uptight against the bearing plate but normally the screw will be only partially tightened so as to allow some looseness or "play" in and between the various parts.

After a connector means 10 has thus been installed in the opposed ends of each of the rail elements 4, 6 the railing section 2 may then be mounted to the newel posts. To accomplish this it is only necessary to locate section 2 between the newel post in the general position it is to finally occupy and to then insert a bolt means 40 inwardly through a suitable one of the openings 38 in the newel posts and within and through the slotted leg portion 20 of a corresponding one of the clips 14, the clip being free for limited movement with respect to the rail element to facilitate the installation of the bolt means. Suitable nuts are then assembled to the bolts 40 and are drawn up thereon to force the clip 14 tightly against the newel post. To complete the installation, it is then only necessary to effect the final in-place tightening of each of the several machine bolts 30 to their respective bearing plate 28.

The procedure which is followed in the instance where the railing section is to be installed along the edges of steps or a ramp, for example, differs from the above principally in that the railing section after being cut to the desired length is then pitched to the angle or slope of the steps or ramp, as the case may be, by application of suitable paralleling, opposed forces to the ends of the rail elements. Also, in the case of a pitched section, the individual clips 14 of the connector means 10 require bending to move the legs 16, 28 from a normal perpendicular position to one another to one in which the included angle of the legs is equal to that included by the posts and the respective ends of the rail elements in the final installed railing unit.

The relative displacement between the legs 16, 28 can be accomplished on site using known techniques and commonly available tools. By way of facilitating the modification of the clip in the instance of a pitched or raked railing section, the portion of the clip 14 at which the leg portions 16, 28 merge is provided with a cut-out or opening 46 so as to reduce the resistance of the legs to bending movement without substantial impairment in the overall strength of the clip in the finally assembled railing unit.

It is believed apparent from the above that the invention provides an extremely effective adjustable type connector means for permitting the assembly of a railing section to fixed supportive structure therefor, such as a pair of newel posts, by an individual home owner or other do-it-yourselfer having limited experience in such matters and using only commonly available hand tools. The present connector means are, by virtue of their compression type action, capable of maintaining the railing section to its associative support structure in a manner as will assure a high degree of tightness and rigidity in the assembled railing structure so that despite this do-it-yourself installation feature of the present railing section a structurally satisfactory final railing assembly is attainable.

The rail elements have a cross-section configuration which is particularly effective from the standpoint of resisting deflection or bending under load and this, in combination with the novel manner in which the connector means is coupled with the rail element, permits the rail elements to be provided with a very favorable weight to strength ratio. In order to enhance the overall aestheticness of the railing assembly and at the same time provide added user confort and safety, the rail elements 4, 6 preferably are contoured over their length, as shown, to include indentations or recesses **18*b* between the outer surfaces of the sides 18 and web portion 26 of the rail elements. The web portion 26 of the rail elements are also formed over their length with a center rib-like element 26*a***.

Various modes of carrying out the present invention are contemplated as being within the scope of the following claims particularly pointing out and distinctly claiming the subject matter regarded as the nature of the invention:

I claim:

1. A clamp-on type connector means for a wrought iron railing section adapted to be connected with a fixed support and which includes rail elements having an inverted, generally U-shaped cross-sectional construction with the opposed sides of such section being formed with continuously extending, internally positioned abutment means, said sides terminating in freely extending, depending edge portions, comprising an L-shaped clip adapted to be fitted to an end of a rail element with a first of its leg portions extending within the end thereof in engaged, seated relation with the abutment means contained in said rail element and with its second leg portion depending from the end of the rail element, a separate, U-section bearing plate adapted to be positioned along the underside of the rail element with the sides of the U extending towards the rail element and fitting immediately outboard of the corresponding free end portions of said side walls of the rail element, said first leg portion of the clip containing an internally threaded aperture and said bearing plate containing an aperture and adapted to be positioned lengthwise of said rail element with the aperture contained therein in vertically aligned relation with the aperture in said first leg portion of said clip and a threaded fastener means adapted to be inserted through said apertures to connect said bearing plate to said clip and operative when tightened into place to draw said plate and clip into firm, frictionally engaging relation with said rail element, said second leg portion of the clip presenting a separate attachment surface for connecting the rail element with said fixed support.

* * * * *